United States Patent [19]

Brolin

[11] 4,269,531

[45] May 26, 1981

[54] ATTACHMENT DEVICE

[76] Inventor: Hans R. Brolin, Parkvägen 24, S-560 41 Mullsjö, Sweden

[21] Appl. No.: 81,532

[22] Filed: Oct. 3, 1979

[30] Foreign Application Priority Data

Nov. 22, 1978 [SE] Sweden ..... 7812045

[51] Int. Cl.[3] ..... F16C 11/00

[52] U.S. Cl. ..... 403/97; 403/146; 160/22

[58] Field of Search ..... 403/97, 96, 224, 146; 160/22, 67

[56] References Cited

U.S. PATENT DOCUMENTS 1,434,803 11/1922 Bloss ..... 403/146

1,932,697 10/1933 Jankovic ..... 403/97

2,987,331 6/1961 Golde ..... 403/146

*Primary Examiner*—Andrew V. Kundrat

*Attorney, Agent, or Firm*—Witherspoon & Hargest

[57] ABSTRACT

The present invention refers to an attachment device for attaching the forward profile bar of an awning or sun-blind to hinge arms. The device comprises a shaft portion adapted to be attached to the outer end of the hinge arm and a profile portion adapted to be attached at the forward profile bar. Both portions are resiliently connected to each other and provided with guide means tending to hold the two portions in a predetermined normal position and to return them to this position when they have been brought out of the normal position.

5 Claims, 6 Drawing Figures

ATTACHMENT DEVICE

The present invention relates to hinge arm awnings or sun-blinds and particularly to an articulated attachment device joining the hinge arm and forward profile bar of such awnings.

In connection with huge hinge arm awnings, in particular awnings used in connection with shop windows or the like it is desirable to displace the hinge arms out of the walking range in front of the window. This problem has been solved long ago by providing wall attachments in which the inner ends of the arms are shiftable to an elevated position towards the awning roll itself. This elevation is normally manually performed but is some times facilitated by certain spring arrangements.

When such an awning is to be lowered or retracted up to this time the co-operation of two persons has been necessary. For, in order not to break the awning construction, it has been neccessary to shift the hinge arms to the greatest possible extent in parallel in the wall attachments and this task is beyond the capability of a single person.

The present invention aims at removing this problem by enabling a single person to extend and retract hinge arm awnings the arms of which are shiftable in wall attachments. This aim is realized by a device of the type indicated in the claims which also define the particular characteristics of the invention.

Figure 1:
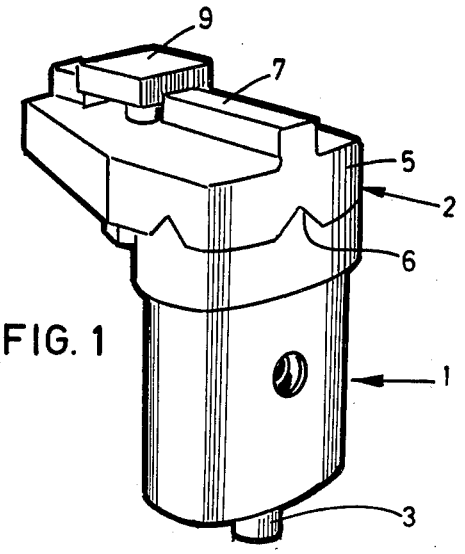
Figure 2:
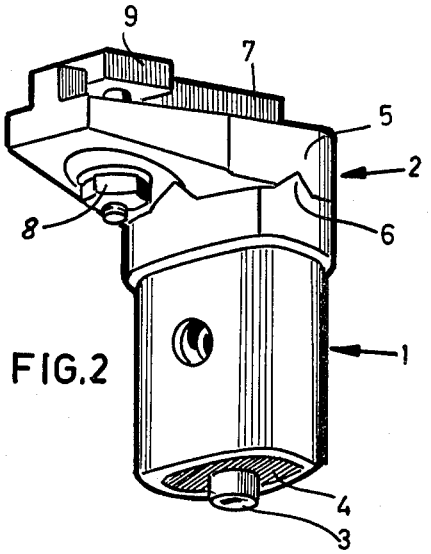
Figure 3:
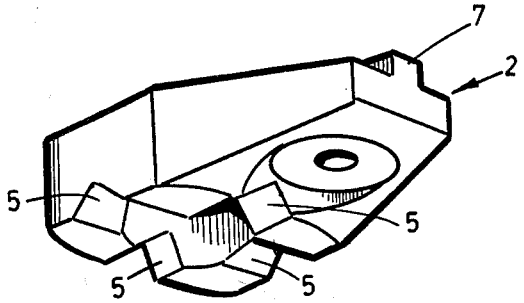
Figure 5:
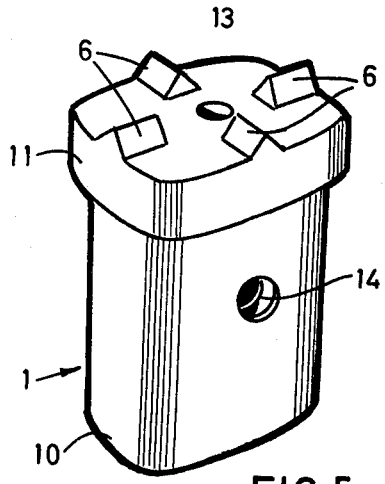
Figure 4:
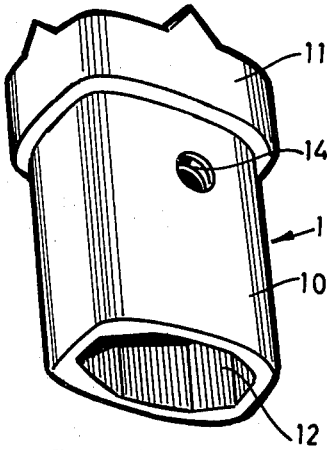
Figure 6:
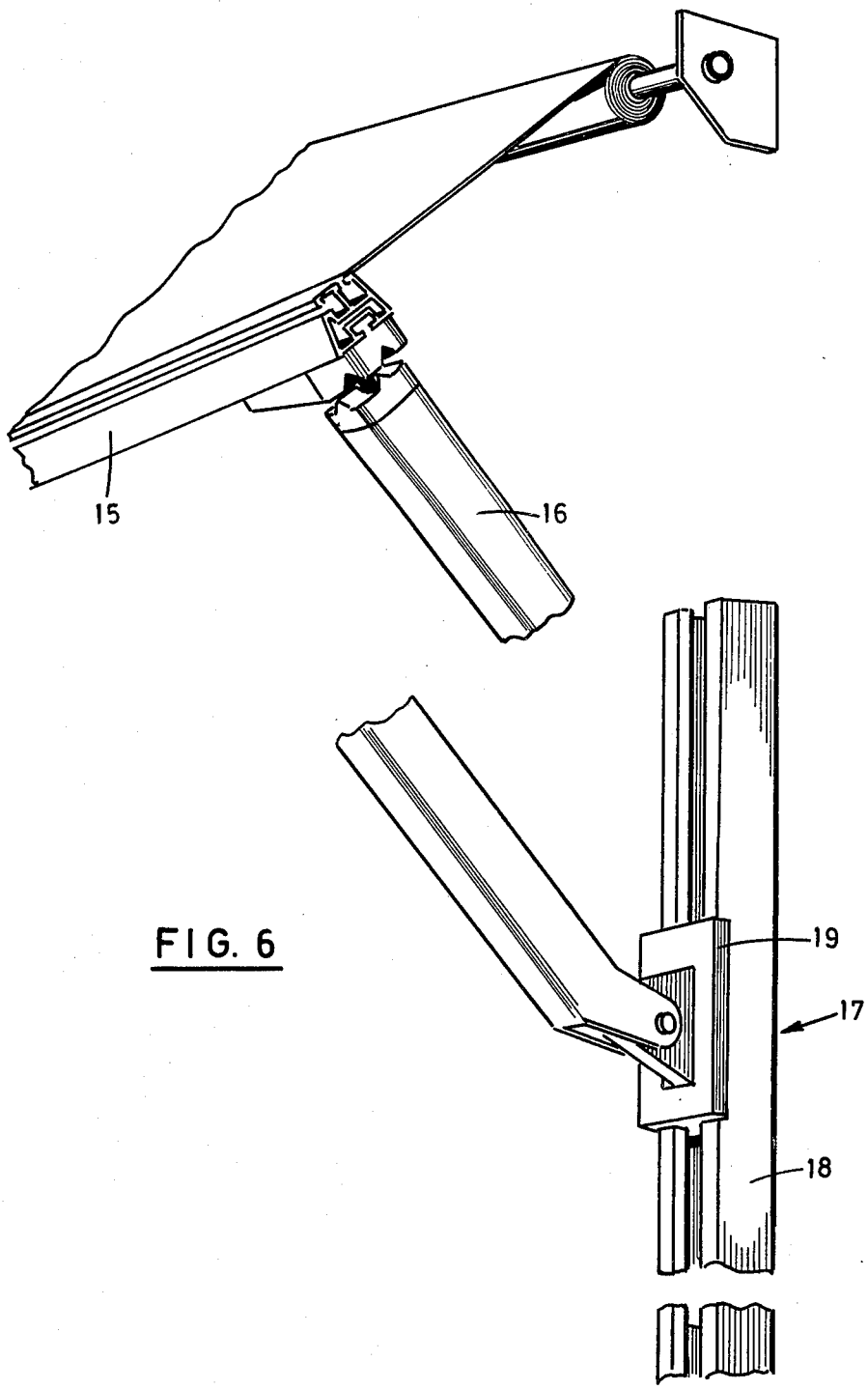

The invention is described in detail hereafter by reference to the attached drawings in which:

FIGS. 1 and 2 are perspective views of an articulate attachment device according to the invention, FIG. 3 is a perspective view of the portion of the attachment device of FIGS. 1 and 2 adapted to be attached to the forward profile bar of an awning, FIGS. 4 and 5 are perspective views of the portion of the attachment device of FIGS. 1 and 2 adapted to be attached to a hinge arm of an awning, and FIG. 6 is a schematic perspective view with some portions broken away and showing how the attachment device according to FIGS. 1 and 2 is operating in a hinge arm awning having a shiftable wall attachment.

The attachment device shown in FIGS. 1 and 2 comprises two portions, a shaft portion 1 and a profile portion 2. The two portions are held together with the aid of a bolt 3 or the like extending through a resilient material 4 in the shaft portion 1 and attached to the profile portion 2.

In the embodiment of the invention shown in the drawings the profile portion 2 in the abutment surface facing the shaft portion 1 is provided with four notches 5, whereas the shaft portion 1 has four ridges 6 extending from the abutment surface and having the same shape as notches 5, the ridges 6 in the normal position of the device lying within notches 5. During relative turning displacement between portions 1 and 2 about bolt 3 the ridges 6 will leave the notches 5 causing the spring bias to increase. When the rotary movement approaches the starting position, i.e. the normal position, the top portions of the ridges start entering into the notches 5 causing the attachment device automatically under the action of spring bias and the inclined surfaces to return to normal position.

The profile portion 2 is provided with a protruding ridge 7 adapted to fit into a groove in a forward profile bar, a bolt 8 having a quadrangular head 9 extending through an interruption in ridge 7. This quadrangular head 9 is intended to rest against the inside surface of portions adjacent the ridge of the forward profile bar to latch the profile portion thereto.

The profile portion 2 is slightly oblong and, as appears from FIG. 3, provided at the one end with said notches 5 and at the other end with a through hole for bolt 8 and a depression around the hole adapted to receive the nut of the bolt.

In the embodiment shown in FIGS. 4 and 5 shaft portion 1 has a portion 10 forming a shaft and adapted to be inserted into the end opening of a tubular hinge arm, and an end portion 11 provided with the previously mentioned ridges 6. A large bore 12 extends through shaft 10 and is adapted to receive the resilient material 4, whereas a small bore 13 extends through end portion 11 through which bolt 3 extends when the attachment device is mounted. In the peripheral surface of shaft 10 one or more depressions 14 are provided permitting a tubular hinge arm to be secured to the shaft portion 1.

In FIG. 6 the attachment device according to the invention is shown inserted between the forward profile bar 15 of an awning and a corresponding hinge arm 16. The wall attachment 17 of the awning comprises a rail 18 and a slide piece 19. The hinge arm is swingably attached to the slide piece 19 which in turn is adapted to be latched in a conventional way in the desired position.

As shown in FIG. 6 the attachment device has been spread apart indicating that the hinge arm not shown has been brought to a position different from that of the hinge arm shown without thereby exposing the forward profile bar to any appreciable torsional stresses. Such stresses instead have resulted in torsional deformation of the attachment devices thereby preventing the awning construction from being exposed to damaging stresses.

Due to the present invention a remarkable improvement has been achieved as far as the operation of hinge arm awnings with shiftable wall attachments is concerned because thanks to the present invention such awnings now can be lowered and retracted by a single person.

An expert on the awning field will realize that other embodiments of the attachment device can be derived on the basis of the knowledge disclosed in the present specification. Thus, the resilient material may be an elastic resinous material, a coil spring or the like, the guide means may be more or less numerous in comparison with the embodiment shown and may also be of different shape. The main point is that these means define a normal position to which the portions of the attachment device easily will return due to the inherent bias.

What we claim is:

1. An attachment device for attachment of a forward profile bar of an awning to a hinge arm comprising a profile portion comprising a first surface for attachment to said forward profile bar and an opposing elongated second surface, a shaft portion comprising a first surface for attachment to said hinge arm and an opposing elongated second surface, a coupling member for resiliently connecting said portions to each other such that said second surfaces face each other, and first returning means positioned on said opposing surface of said profile portion, and second returning means positioned at said opposing surface of said shaft portion and removeably engaging said first returning means, for maintaining said portions in a predetermined position during normal conditions of said awning and returning said portions to said predetermined position when said portions are caused to move relative to each other during operation of said awning.

2. An attachment device according to claim 1 wherein said first returning means comprises a plurality of notches within said opposing surface of said profile portion, said notches being spaced such that said opposing surface of said profile portion forms a land area between adjacent of said notches, and said second returning means comprises a plurality of ridges protruding from said opposing surface of said shaft portion and in alignment with and shaped to mesh with said notches, said ridges being spaced such that said opposing surface of said shaft portion forms a land area between adjacent of said ridges.

3. An attachment device according to claims 1 or 2 wherein said coupling member comprises a bolt extending through a resilient member and through an aperture in said opposing surface of said shaft portion and into said opposing surface of said profile portion.

4. An attachment device according to claim 3 wherein said resilient member comprises an elastic resinous material.

5. An attachment device for attachment of a forward profile bar of an awning to a hinge arm comprising a profile portion having a first surface for attachment to said forward profile bar and an opposing second surface, one end of said opposing surface of said profile portion comprising a plurality of notches, said notches being spaced such that said opposing surface of said profile portion forms a land area between adjacent of said notches, the opposite end of said opposing surface of said profile bar including an aperture which extends therethrough to said first surface of said profile bar, said first surface of said profile bar including a protruding ridge which extends from one end thereof to the other with the exception that said ridge is discontinuous at said aperture, a bolt extending through said aperture and having a head portion which fits into said discontinuous portion of said ridge, a shaft portion comprising an elongated sleeve-like member having a first surface for attachment to said hinge arm and an opposing second surface, said opposing surface of said shaft portion comprising a flanged surface having a plurality of ridges protruding from said flanged surface and shaped to mesh with said notches, said ridges being spaced such that said flanged surface forms a land area between adjacent of said ridges, said flanged surface including an aperture therethrough, a resilient member positioned within said elongated sleeve-like member, and a bolt extending through said resilient member and said aperture in said flanged surface, said bolt being attached to said opposing surface of said profile portion, and said opposing surface of said profile portion thereby being resiliently attached to said flanged surface such that said ridges removeably mesh with said notches.

* * * * *